US008150292B2

(12) United States Patent
Ohashi

(10) Patent No.: US 8,150,292 B2
(45) Date of Patent: Apr. 3, 2012

(54) DEVELOPING UNIT AND IMAGE FORMING APPARATUS COMPRISING SAME

(75) Inventor: Hiroaki Ohashi, Osaka (JP)

(73) Assignee: Kyocera Mita Corporation (JP)

( * ) Notice: Subject to any disclaimer, the term of this patent is extended or adjusted under 35 U.S.C. 154(b) by 401 days.

(21) Appl. No.: 12/570,375

(22) Filed: Sep. 30, 2009

(65) Prior Publication Data

US 2010/0080606 A1 Apr. 1, 2010

(30) Foreign Application Priority Data

Sep. 30, 2008 (JP) ..... 2008-252572
Sep. 30, 2008 (JP) ..... 2008-252573

(51) Int. Cl.
*G03G 21/20* (2006.01)

(52) U.S. Cl. ..... 399/92; 399/119

(58) Field of Classification Search ..... 399/92, 399/119

See application file for complete search history.

(56) References Cited

U.S. PATENT DOCUMENTS 6,785,490 B2 * 8/2004 Tsukamoto et al. ..... 399/94
2008/0063425 A1 * 3/2008 Idehara et al. ..... 399/93
2008/0170876 A1 * 7/2008 Sakai et al. ..... 399/93
2010/0098452 A1 * 4/2010 Inaba ..... 399/92

FOREIGN PATENT DOCUMENTS

JP 11202736 A * 7/1999
JP 2005266249 A * 9/2005
JP 2006-139045 6/2006

OTHER PUBLICATIONS

JP 11202736 A, Jul. 1999, English abstract to Nishikino.*
JP 2005266249 A, Jul. 2005, English abstract to Sakai et al.*

* cited by examiner

*Primary Examiner* — Ryan Walsh
(74) *Attorney, Agent, or Firm* — Gerald E. Hespos; Michael J. Porco

(57) ABSTRACT

A developing unit includes a unit main body having an internal space defined by a predetermined frame and capable of supplying a developer to the outside while agitating the developer within the internal space, a unit-side cooling duct attached to the unit main body, and a duct connecting member connecting the unit-side cooling duct and an external duct which supplies a cooling gas to the unit-side cooling duct from outside the unit main body. The unit-side cooling duct is structured by a duct piece and a part of the predetermined frame. The duct piece is detachably attached to the unit main body in opposed relation to the part of the predetermined frame, and has an end that is fitted to the duct connecting member.

20 Claims, 9 Drawing Sheets

DEVELOPING UNIT AND IMAGE FORMING APPARATUS COMPRISING SAME

BACKGROUND OF THE INVENTION

1. Field of the Invention

The present invention relates to a developing unit having a cooling duct, and an image forming apparatus which includes the developing unit.

2. Description of the Related Art

In an image forming apparatus, suppressing an increase in temperature of the developer within the developing unit during image formation processing is one effective method of obtaining a high-quality image. Japanese Patent Application Publication No. 2006-139045, for example, is known as means for suppressing an increase in the developer temperature.

In the case of the developing unit of Japanese Patent Application Publication No. 2006-139045, an increase in the developer temperature is suppressed using a cooling duct (heat sink); more specifically, a cooling duct made of aluminum having high heat conductivity is disposed adjacent to a developer restricting blade, for restricting the amount of developer on the developing roller, whereby the heat retained by the developer is transferred to the cooling duct via the developer restricting blade and thus dissipated.

However, although the cooling duct of the developing unit is capable of suppressing an increase in temperature, assemblability cannot be said to be favorable. More specifically, the cooling duct is incorporated within the developing unit in a state of being surrounded, not only by the frame of the apparatus main body of the developing unit but also by the supporting frames of the developer restricting blade and other members inside the developing unit. Installation of the cooling duct in the developing unit is therefore complicated.

SUMMARY OF THE INVENTION

The present invention was conceived in view of the above, and an object of the invention is to provide a developing unit in which a cooling duct can be easily installed, and an image forming apparatus which includes the developing unit.

A developing unit according to one aspect of the present invention includes a unit main body having an internal space defined by a predetermined frame and capable of supplying a developer to the outside while agitating the developer within the internal space, a unit-side cooling duct attached to the unit main body, and a duct connecting member connecting the unit-side cooling duct and an external duct which supplies a cooling gas to the unit-side cooling duct from outside the unit main body. The unit-side cooling duct is structured by a duct piece and apart of the predetermined frame. The duct piece is detachably attached to the unit main body in opposed relation to the part of the predetermined frame, and has an end that is fitted to the duct connecting member.

Further objects of the present invention and specific advantages obtained by the present invention will become more apparent from the description of the embodiment described hereinafter.

DETAILED DESCRIPTION OF THE PREFERRED EMBODIMENTS

Preferred embodiments of the present invention will be described in detail hereinafter with reference to the drawings.

Figure 1:
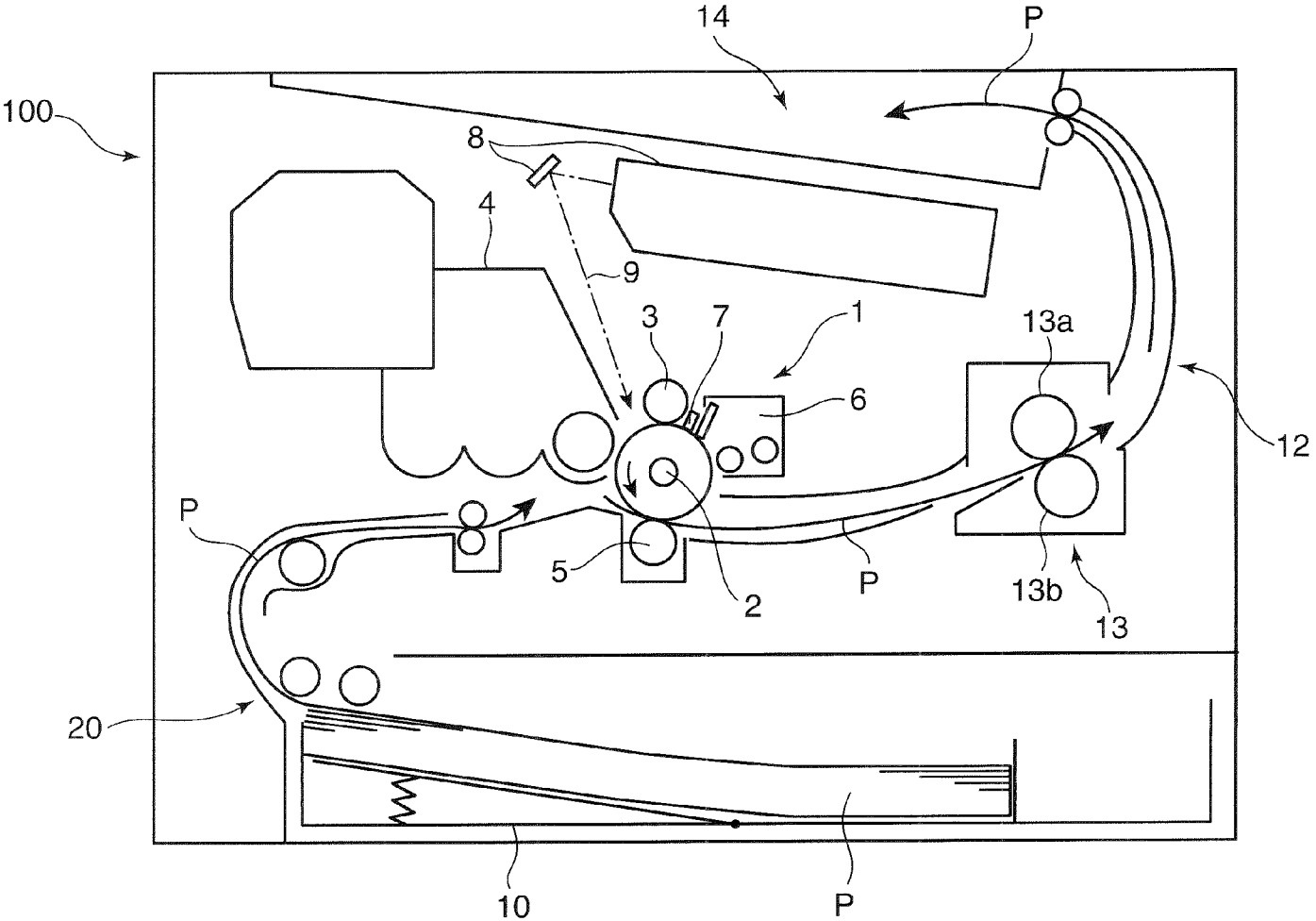
FIG. 1 is a front view of the overall structure of an image forming apparatus according to an embodiment of the present invention.

FIG. 1 is a front view of the overall structure of an image forming apparatus according to an embodiment of the present invention. The image forming apparatus may, for example, be any of a printer, a copier, a facsimile, or an apparatus that combines the aforementioned devices. This embodiment, however, will be described for a case where the image forming apparatus is a printer. Furthermore, the image forming apparatus is described as being a monochrome printer but may also be a tandem color printer.

The image forming apparatus includes an apparatus main body 100, the apparatus main body 100 including an image forming section 1, which forms a toner image on a recording medium, such as a sheet P, based on image data transmitted from external device such as a computer, a fixing section 13 that performs fixing to fix the toner image on the sheet P to the sheet P, a sheet storage section 10 for storing the sheet P, and a sheet ejection section 14 for ejecting the sheet P subjected to fixing.

The image forming section 1 comprises a photosensitive drum (image carrying member) 2 on the peripheral surface of which an electrostatic latent image, and a toner image according to the electrostatic latent image are formed, a charger 3 for uniformly charging the peripheral surface of the photosensitive drum 2, a developing unit 4 for supplying toner (developer) to the electrostatic latent image on the peripheral surface of the photosensitive drum 2; a transfer roller 5, which forms a nip with the photosensitive drum 2 and transfers the toner image to the sheet P which has passed through the nip; a cleaning unit 6 for cleaning the peripheral surface of the photosensitive drum 2 by removing residual toner thereon; and a static eliminator 7 for removing a residual potential of the photosensitive drum 2. The charger 3, the developing unit 4, the transfer roller 5, the cleaning unit 6, and the static eliminator 7 are disposed around the photosensitive drum 2, along the direction of rotation, indicated by the arrow, of the photosensitive drum 2. Furthermore, the image forming section 1 includes an exposure device 8 which is disposed above the photosensitive drum 2 and exposes the peripheral surface of the photosensitive drum 2.

The fixing section 13 includes a heating roller 13*a*, which contains an energized heating element as a heat source, and a pressing roller 13*b* disposed facing the heating roller 13*a*, a nip, through which the sheet P passes, being formed between the heating roller 13*a* and the pressing roller 13*b*.

Furthermore, the interior of the apparatus main body 100 is formed with a sheet conveyance path 12 for conveying the sheet P in the sheet storage section 10 to the image forming section 1, the fixing section 13, and the sheet ejection section 14. The apparatus main body 100 also has inside a sheet feeder 20 capable of delivering the sheets P one sheet at a time from the sheet storage section 10.

The image formation performed by the image forming apparatus is performed as follows. After the peripheral surface of the photosensitive drum 2 is uniformly charged by the charger 3, the peripheral surface of the photosensitive drum 2 is exposed by radiating the peripheral surface with laser light 9 using the exposure device 8 based on image data. An electrostatic latent image is thus formed on the peripheral surface of the photosensitive drum 2. Thereafter, toner is supplied to the electrostatic latent image from the developing unit 4, and the latent electrostatic latent image is developed. As a result, a toner image is formed on the peripheral surface of the photosensitive drum 2. Thereafter, when the sheet P, conveyed by the sheet conveyance path 12 from the sheet storage section 10, passes through the nip between the photosensitive drum 2 and the transfer roller 5, the toner image is transferred to the sheet P. During the transfer, a transfer bias is applied between the photosensitive drum 2 and the transfer roller 5, whereby the charged toner is smoothly transferred to the sheet P.

Following the toner image transfer, the sheet P is conveyed to the fixing section 13, and fixing is carried out as the sheet P passes through the nip between the heating roller 13*a* and the pressing roller 13*b*, thereby obtaining heat from the heating roller 13*a*. After being subjected to fixing, the sheet P is discharged to the sheet discharge section 14.

Toner which remains on the peripheral surface of the photosensitive drum 2 after the toner image has been transferred to the sheet P from the photosensitive drum 2 is recovered by the cleaning unit 6, whereupon the residual potential on the peripheral surface of the photosensitive drum 2 is eliminated by the static eliminator 7. Thereafter, the photosensitive drum 2 is charged once more by the charger 3 and the image formation described above is repeated.

Note that a two-component developer consisting of 'toner' and a 'magnetic carrier' is used, by way of an example, for the 'developer' in this specification, but a one-component developer consisting only of toner may also be used.

Furthermore, in the image forming apparatus with the above structure, the developing unit 4 of the image forming section 1, for example, generates heat in the course of the image formation. As will be described subsequently, the developing unit 4, which stores the developer, agitates the developer while supplying the developer to the photosensitive drum 2, and hence the developer is caused to generate frictional heat due to the agitation operation. Due to the frictional heat, the temperature of the developer increases, and there is a drop in the fluidity and charging property thereof. As a result, it is difficult to form a high-quality toner image on the photosensitive drum 2. In order to raise the quality of the toner image, therefore, the developer must be cooled in the developing unit 4. To this end, a cooling structure is provided in the developing unit 4 in this embodiment. The cooling structure is constituted by unit-side first to third cooling ducts 46, 47, and 48, disposed inside the developing unit 4, main body-side first to third cooling ducts (external ducts) 60, 61, and 62, disposed in the apparatus main body 100, and first to third connecting ducts 70, 71, and 72 which connect the unit-side first to third cooling ducts 46, 47, and 48, and the main body-side first to third cooling ducts 60, 61, and 62. The cooling structure will be described hereinafter together with the structure of the developing unit 4.

Figure 2:
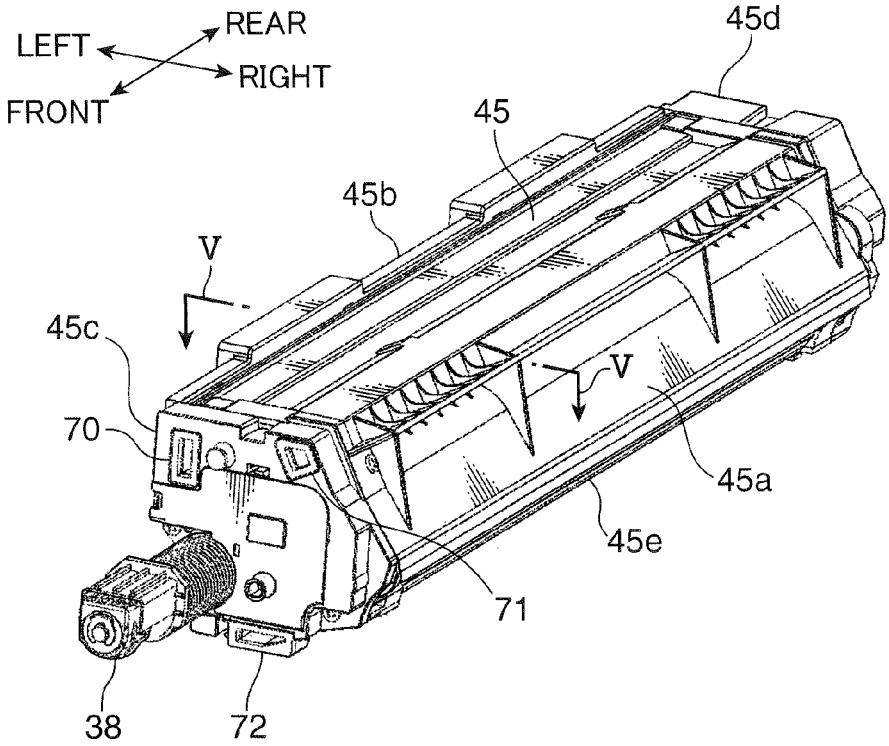
FIG. 2 is an external perspective view in which a developing unit, provided with a cooling structure, of the image forming apparatus is viewed from the front.
Figure 3:
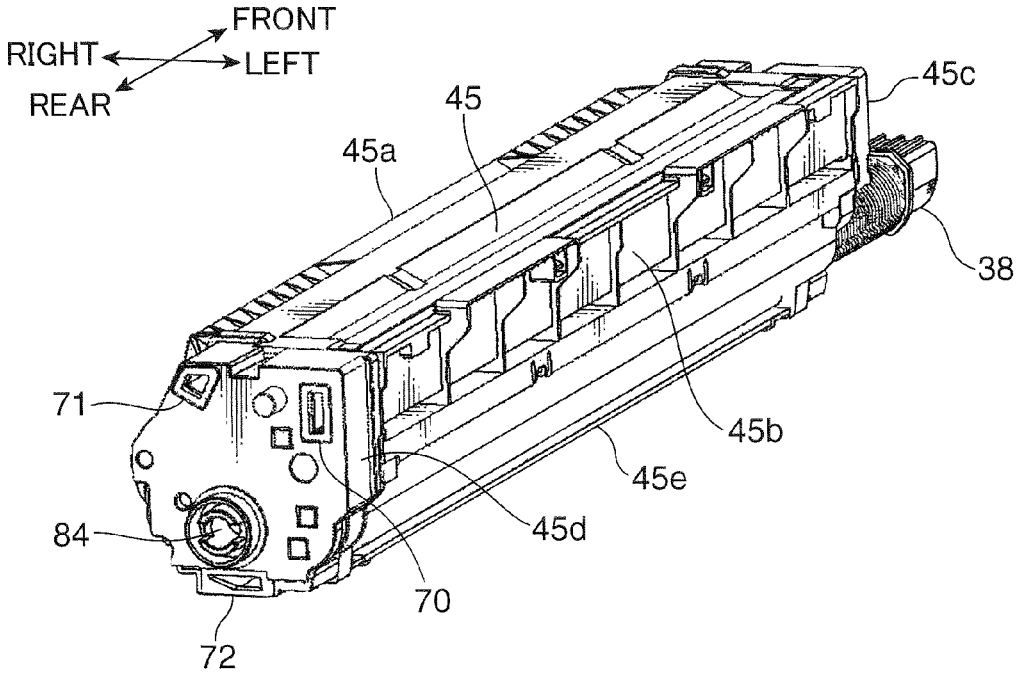
FIG. 3 is an external perspective view in which the developing unit is viewed from the rear.

FIGS. 2 and 3 are, respectively, an external perspective view in which the developing unit 4, provided with a cooling structure, is viewed from the front, and an external perspective view in which the developing unit 4 is viewed from the rear. The developing unit 4 comprises a developing container (unit main body) 45 which demarcates the internal space of the developing unit 4, and extends in a front to rear direction of the apparatus main body 100 (a direction perpendicular to the surface of the paper of FIG. 1). The developing container 45 includes a first cover 45*a*, which extends in a front to rear direction and covers a magnetic roller 51 or the like, described subsequently, from the left and right; a second cover 45*b*, which extends in a front to rear direction and covers the unit-side first cooling duct 46, described subsequently, from the left side; a front side plate 45*c*, which covers a front end 4*a* (FIG. 4) of the developing unit 4 in a front to rear direction; a rear side plate 45*d*, which covers a rear end 4*b* of the developing unit 4 in a front to rear direction; and a base plate 45*e* which demarcates a developer storage section 41, described subsequently. The first cover 45*a*, the second cover 45*b*, the front side plate 45*c*, the rear side plate 45*d*, and the base plate 45*e* constitute a frame for the developing container 45.

Figure 4:
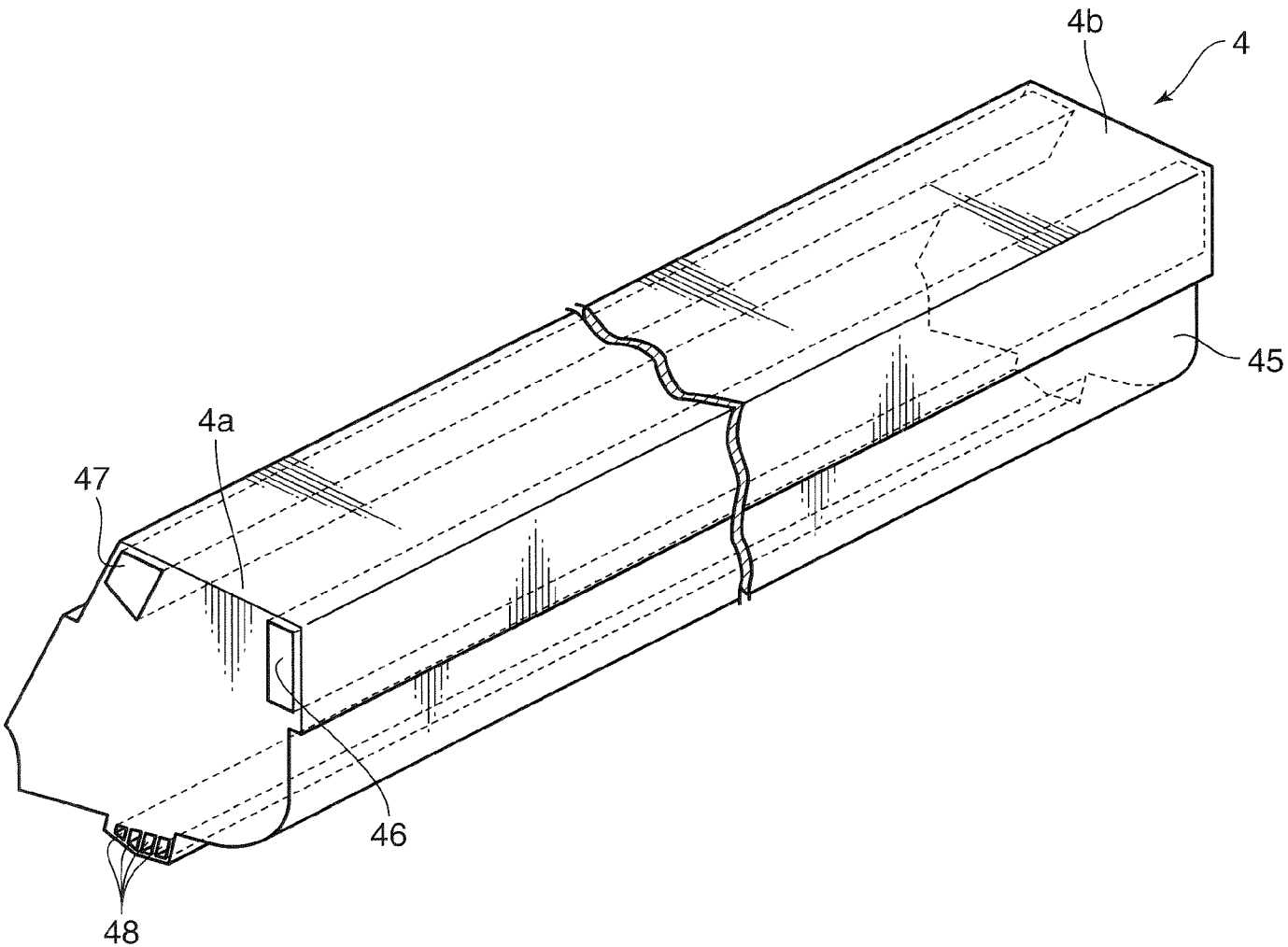
FIG. 4 is an external perspective view in which the developing unit is viewed from the rear, the external of the developing unit being shown in simplified form to facilitate the description.

FIG. 4 is an external perspective view in which the developing unit 4 is viewed from the rear, in which the external of the developing unit 4 is shown in simplified form, with the front side plate 45*c* and the rear side plate 45*d* omitted in order to simplify the description. Disposed in the internal space of the developing unit 4 are three unit-side cooling ducts, namely, the first cooling duct 46, the second cooling duct 47, and the third cooling duct 48, which extend in a longitudinal direction (that is, in the front to rear direction of the apparatus main body 100) from the front end 4*a* to the rear end 4*b* of the developing unit 4. A cooling gas, for example air, is supplied from the main body-side first to third cooling ducts 60, 61, and 62, described hereinafter, to the unit-side first to third cooling ducts 46, 47, and 48.

Returning now to FIGS. 2 and 3, first to third duct connecting members 70, 71, and 72, which connect the unit-side first to third cooling ducts 46, 47, and 48, and the main body-side first to third cooling ducts 60, 61, and 62, are integrally formed in positions corresponding to the unit-side first to third cooling ducts 46, 47, and 48 in the front-side plate 45*c* and the rear-side plate 45*d* respectively. The first to third duct connecting members 70, 71, and 72 have a cross-sectional shape that corresponds to the cross-sectional shape of the unit-side first to third cooling ducts 46, 47, and 48. Note that instead of integrally forming the first to third duct connecting members 70, 71, and 72 in the front side plate 45*c* and the rear side plate 45*d* respectively, openings may be formed in the front side plate 45*c* and rear side plate 45*d* in positions corresponding to the unit-side first to third cooling ducts 46, 47, and 48, and the first to third duct connecting members 70, 71, and 72 may be fitted into these openings.

Figure 5:
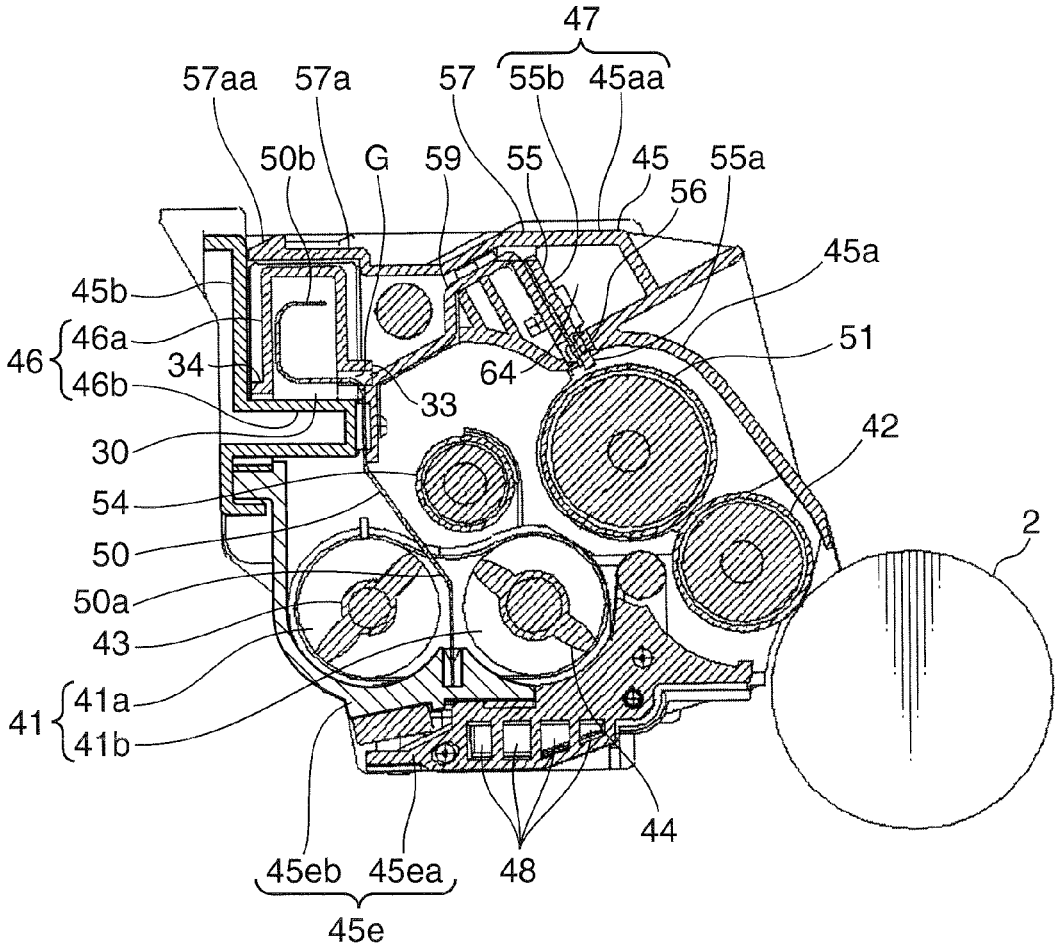
FIG. 5 is a cross-sectional view, along the line V-V of FIG. 2, showing the internal structure of the developing unit and the disposition of a unit-side cooling duct of the cooling structure.

FIG. 5 is a cross-sectional view along the line V-V in FIG. 2, showing the internal structure of the developing unit 4, and the arrangement of the unit-side first to third cooling ducts 46, 47, and 48. The developing container 45 (unit main body) of the developing unit 4 includes, in its internal space, the developer storage section 41 which stores toner-containing developer and enables the developer to be conveyed while being agitated; a developing roller 42, which forms a toner image on the peripheral surface of the photosensitive drum 2 by supplying toner (developer) to the peripheral surface; the magnetic roller 51, which is disposed opposite the developing roller 42 and supplies developer to the developing roller 42; a drawing roller 54, disposed above the developer storage section 41 and close to the magnetic roller 51, for drawing developer from the developer storage section 41 and supplying the developer to the magnetic roller 51; and a developer restricting blade (developer restricting member) 55 for restricting the amount of developer supplied to the magnetic roller 51 from the developer storage section 41. The developing roller 42, the magnetic roller 51, and the drawing roller 54 are arranged within the developing unit 4 such that their center axes extend in a longitudinal direction of the developing unit 4 in the same way as the unit-side first to third cooling ducts 46, 47, and 48.

The developer storage section 41 is constituted by two adjoining developer storage chambers 41*a* and 41*b* that extend in the longitudinal direction of the developing unit 4. The developer storage chambers 41*a* and 41*b* are demarcated by a first base plate part 45*ea* and a second base plate part 45*eb*, which constitute the base plate 45*e*. The developer storage chambers 41*a* and 41*b* are partitioned from each other in the longitudinal direction by a partition plate 50 made of a metal such as aluminum, for example, and communicate with each other via two corner portions in the longitudinal direction. Screw feeders 43 and 44, which agitate the developer due to their rotation, are rotatably mounted in the developer storage chambers 41*a* and 41*b*. The screw feeders 43 and 44 are set to have mutually opposite conveyance directions, and hence the developer is conveyed while being agitated between the developer storage chamber 41*a* and the developer storage chamber 41*b*. A toner inlet (FIG. 2) 38, which protrudes farther forward than the front side plate 45*c* of the developing container 45, is installed in the developer storage chamber 41*a*, and the developer storage section 41 receives toner from a toner cartridge (not shown in the drawing) via the toner inlet 38.

The developer restricting blade 55 is a plate member which is fixed to an inner frame 59 forming part of the developing container 45, and extends in the longitudinal direction of the developing unit 4. The developer restricting blade 55 restricts the amount of developer supplied from the drawing roller 54 by restricting the amount of developer that adheres magnetically to the peripheral surface of the magnetic roller 51. A slight gap of predetermined dimensions is formed between a tip 55*a* of the developer restricting blade 55 and the peripheral surface of the magnetic roller 51, and when the magnetic roller 51 rotates, the developer is restricted by the tip 55*a* of the developer restricting blade 55 in this gap. As a result, a layer of developer of a predetermined thickness is uniformly formed over the peripheral surface of the magnetic roller 51.

Figure 6:
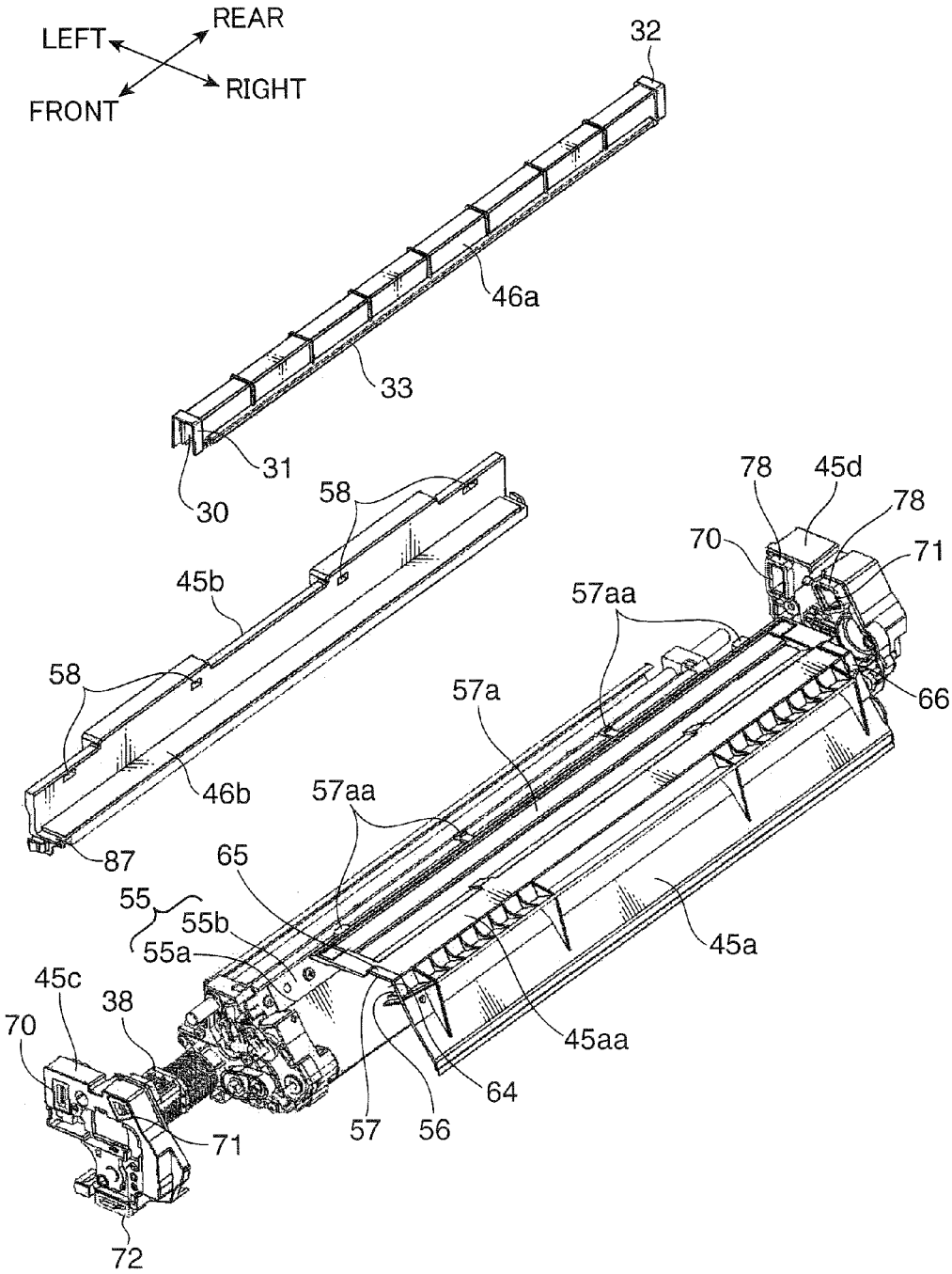
FIG. 6 is an exploded perspective view in which the developing unit is viewed from the front, showing a state prior to assembly of a developing container of the developing unit.
Figure 7:
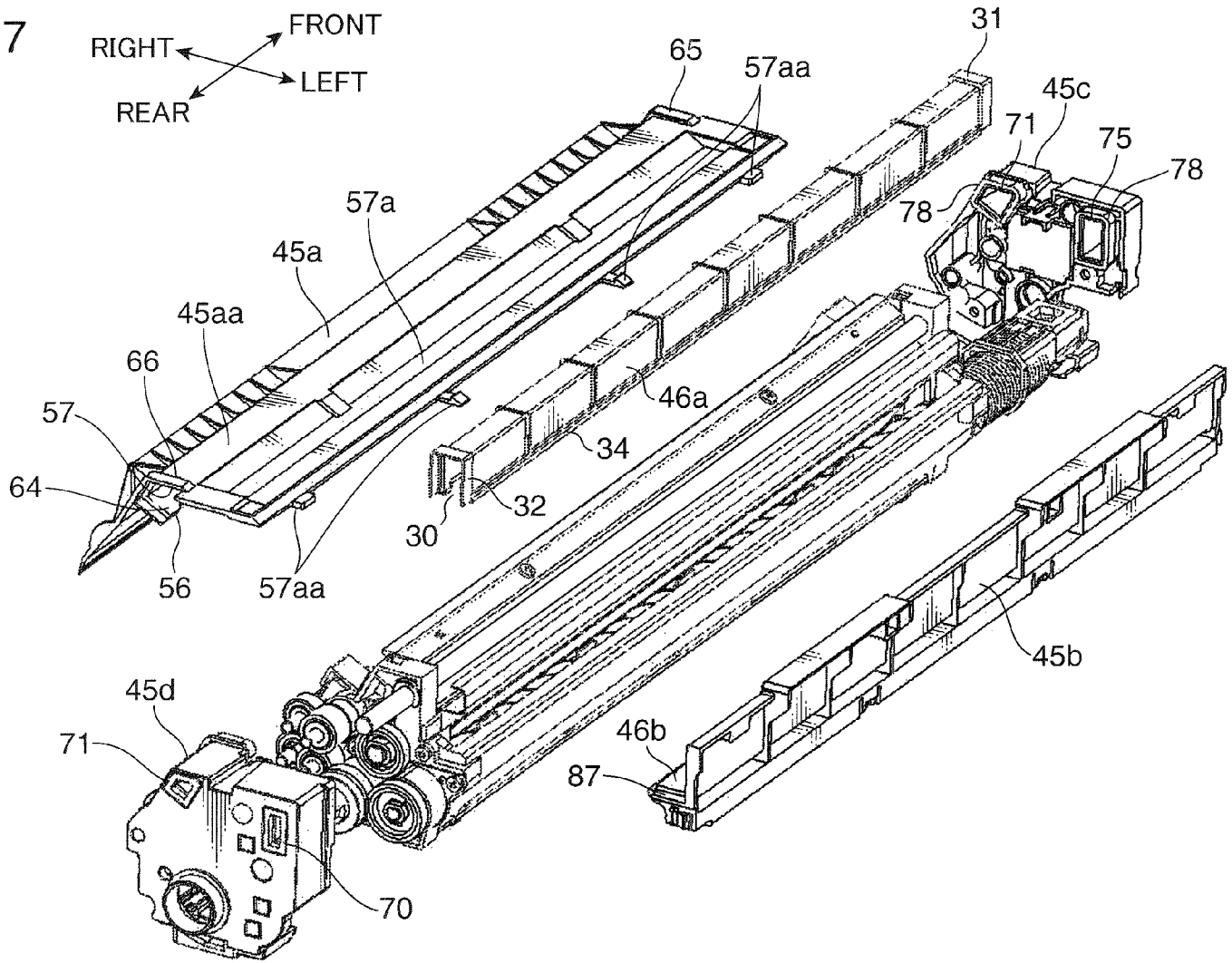
FIG. 7 is an exploded perspective view in which the developing unit is viewed from the rear, showing a state prior to assembly of the developing container of the developing unit.

The unit-side first cooling duct 46 and the unit-side second cooling duct 47 in particular will be described next with reference to FIGS. 5, 6 and 7. FIGS. 6 and 7 are, respectively, an exploded perspective view in which the developing unit 4 is viewed from the front, and an exploded perspective view in which the developing unit 4 is viewed from the rear, both showing a state prior to assembly of the developing container 45.

First, the unit-side first cooling duct 46 is located in the top left corner of the internal space of the developing unit 4, and is constituted by a duct main body (duct piece) 46*a* with a substantially U-shaped (or inverted U-shaped) cross-section that extends in the longitudinal direction of the developing unit 4, along the second cover 45*b*; and a base plate 46*b*, a part of the second cover 45*b*, to allow the duct main body 46*a* to be detachably seated. The duct main body 46*a* has an opening 30 that extends in the longitudinal direction of the developing unit 4. When the duct main body 46*a* is seated on the base plate 46*b* such that the opening 30 in the duct main body 46*a* is blocked by the base plate 46*b*, a flow path that extends in the longitudinal direction of the developing unit 4 is formed between the duct main body 46*a* and the base plate 46*b*.

Figure 10:
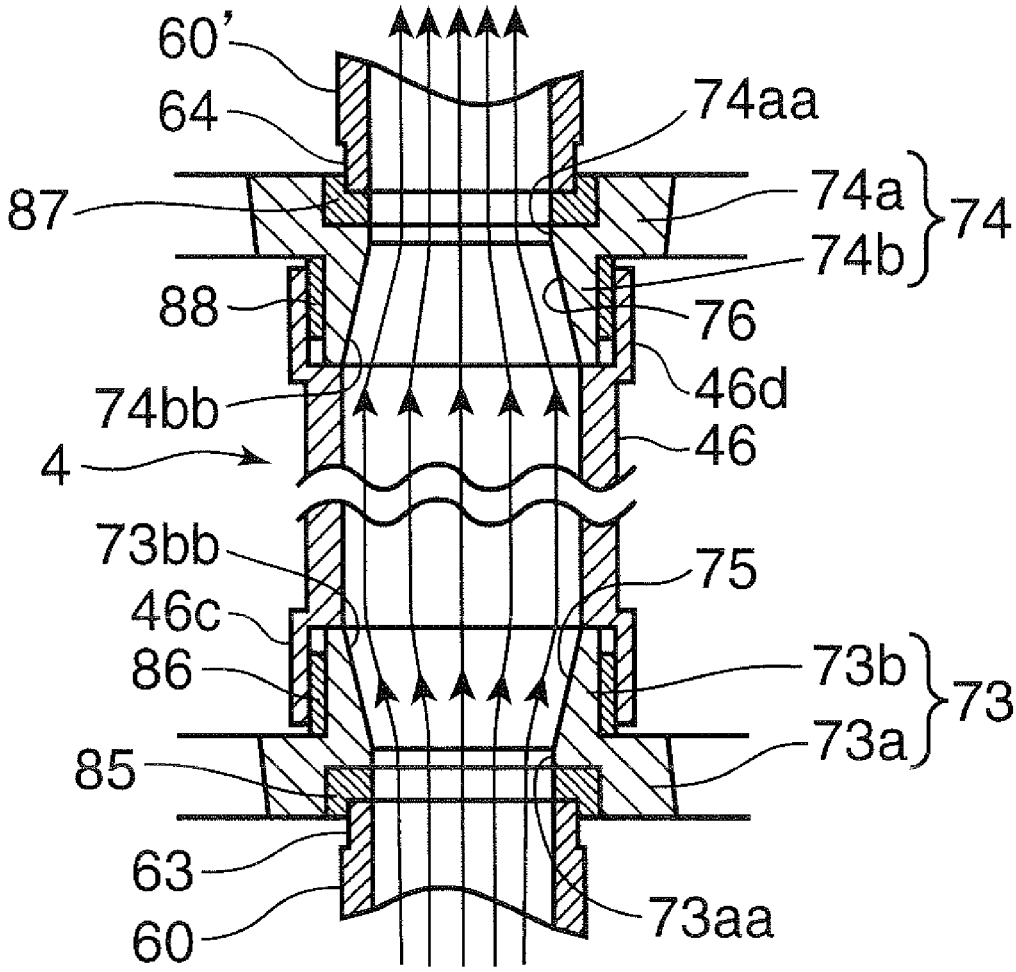
FIG. 10 is a cross-sectional view, from above the developing unit, of a connection structure of the unit-side first cooling duct and the main body-side first cooling duct, the cooling structure serving as a representative example.
Figure 11:
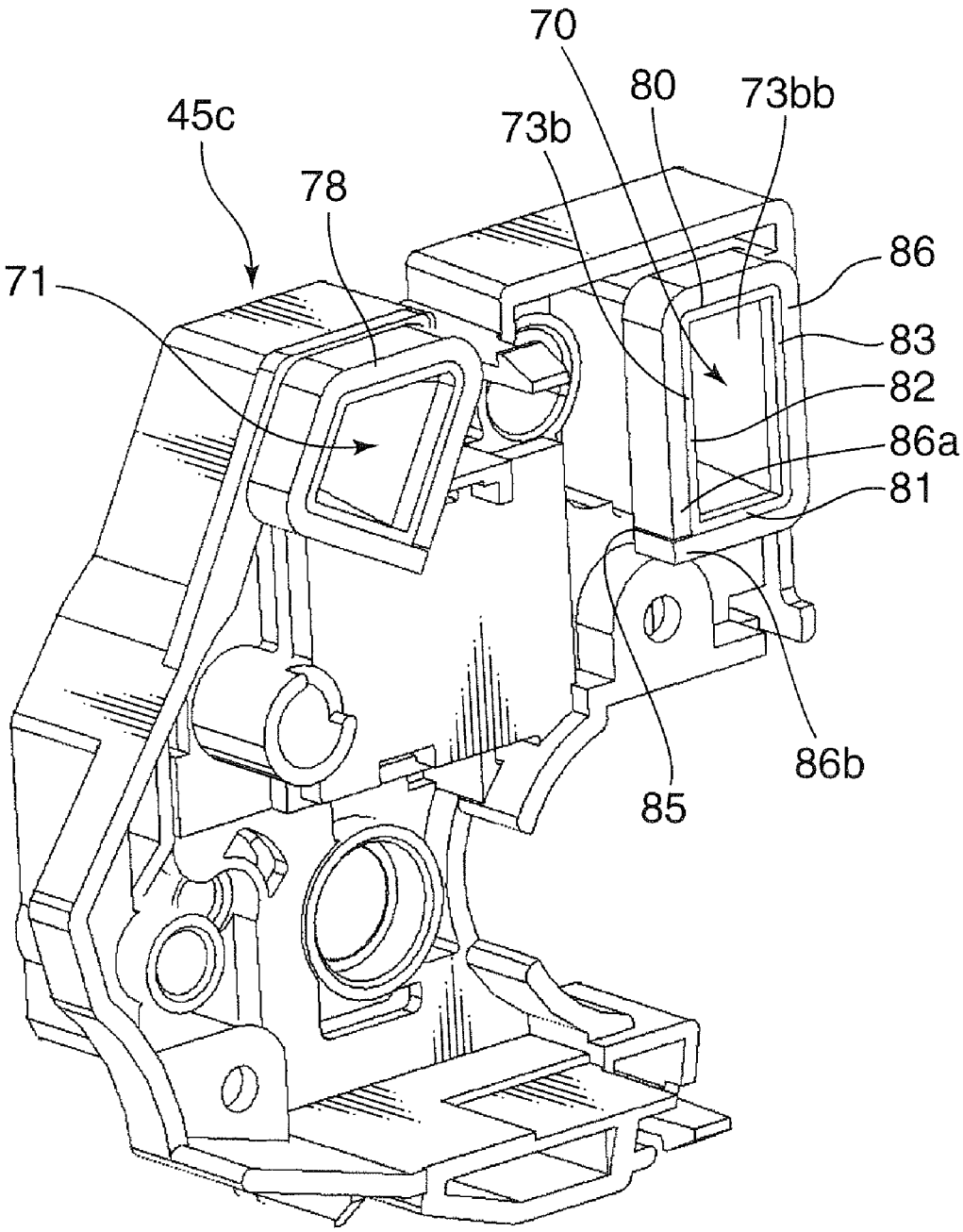
FIG. 11 is a perspective view of a state in which a seal member is wound around the fitting portions where the duct connecting members engage with the cooling ducts.

Furthermore, when the second cover 45*b* engages with the second base plate part 45*eb* and the duct main body 46*a* is seated on the base plate 46*b*, the upstream end 31 and the downstream end 32 of the duct main body 46*a* are detachably fitted, from above, to unit-side fitting portions 73*b* and 74*b* (FIG. 10) of the first duct connecting member 70, described subsequently. Consequently, the unit-side first cooling duct 46 and the main body-side first cooling duct 60 (FIG. 9) are allowed to communicate by the first duct connecting member 70 (FIG. 11).

The duct main body 46*a* also includes a pair of opening edge portions 33 and 34 that extend in the longitudinal direction. The first opening edge portion 33 (on the right in FIG. 5) is formed at a different level from the second opening edge portion 34 (on the left in FIG. 5), and therefore a certain gap G is formed between the right-hand opening edge portion 33 and the base plate 46*b*. The partition plate 50 of the developer storage section 41 extends into the flow path of the unit-side first cooling duct 46 via this gap G. More specifically, one end 50*a* of the partition plate 50 is installed between the developer storage chambers 41*a* and 41*b* so as to partition the developer storage chambers 41*a* and 41*b*, while the other end 50*b* is shaped to pass into the unit-side first cooling duct 46 via the gap G. The other end 50*b* has an inverted U shape in FIG. 5, but there are no particular limitations on the shape.

Figure 8:
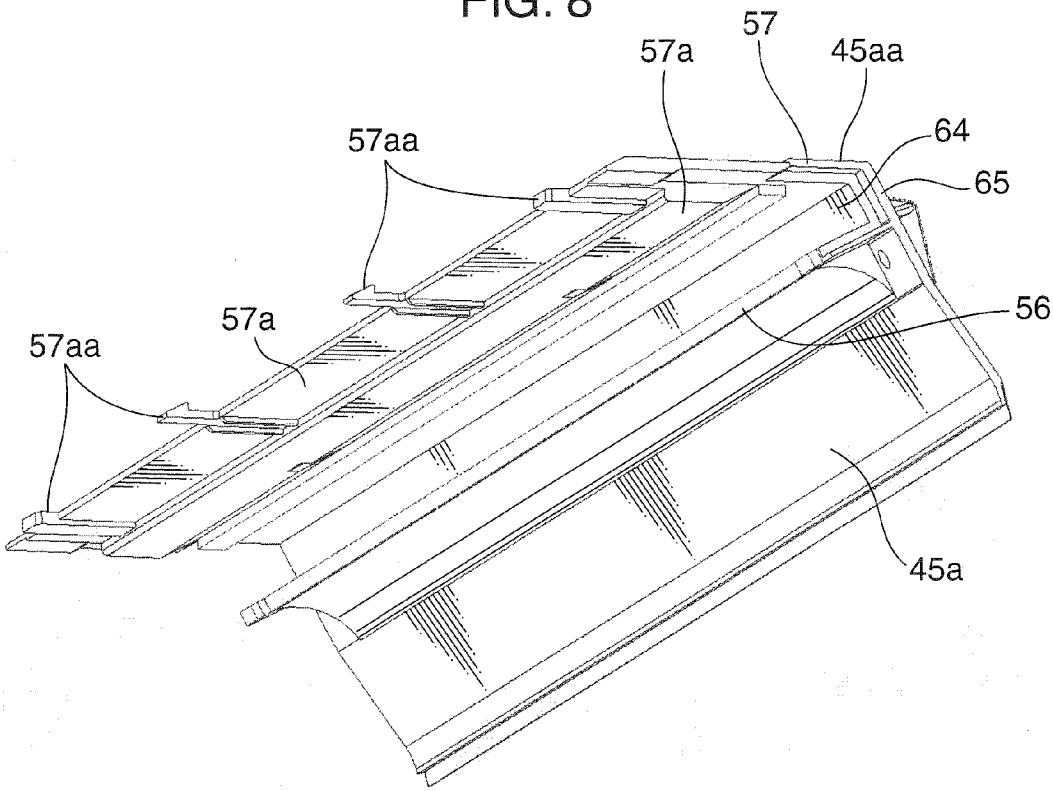
FIG. 8 is a perspective view in which a first cover of the developing container is viewed from inside the developing unit.

The unit-side second cooling duct 47 extends in the longitudinal direction along the upper right corner, in the internal space of the developing container 45, which corresponds to a point above the magnetic roller 51, the flow path of this duct 47 being demarcated using a first cover 45*a* of the developing container 45, and the developer restricting blade 55. More specifically, the unit-side second cooling duct 47 is constituted by a duct main body (duct piece) 45*aa*, obtained by forming a part of the first cover 45*a* corresponding to a point above the magnetic roller 51 substantially into a U shape, and a main body part 55*b* excluding the tip 55*a* of the developer restricting blade 55. As shown in FIG. 8, the duct main body 45*aa* has an opening 64 that extends in the longitudinal direction of the developing unit 4. When the second cover 45*a* is mounted in the developing unit 4, the opening 64 in the duct main body 45*aa* is blocked by the main body part 55*b* of the developer restricting blade 55, and therefore a flow path that extends in the longitudinal direction of the developing unit 4 is formed between the duct main body 45*aa* and the main body part 55*b*.

Furthermore, when the first cover 45*a* is mounted in the developing unit 4, the upper end 65 and the lower end 66 of the duct main body 45*aa* is detachably fitted to the second duct connecting member 71 (FIG. 11), described hereinafter.

As a result, the unit-side second cooling duct 47 and the main body-side second cooling duct 61 (FIG. 9) are allowed to communicate by the second duct connecting member 71.

Additionally, the duct main body 45*aa* has a pair of opening edge portions 56 and 57 which extends in the longitudinal direction and opposes vertically. The first opening edge portion (the lower portion in FIG. 5) 56 is set to abut against the surface of the main body part 55*b* of the developer restricting blade 55. The second opening edge portion (the upper portion in FIG. 5) 57 is extended toward the second cover 45*b* so as to cover, from above, the unit-side first cooling duct 46 when the first cover 45*a* is mounted in the developing unit 4. Engagement protrusions 57*aa*, spaced apart by a certain interval in the longitudinal direction of the developing unit 4, are formed in the edge of the extension 57*a* of the opening edge portion 57. When the first cover 45*a* is mounted in the developing unit 4, the engagement protrusions 57*aa* engage with an engagement hole 58 formed in a suitable location in the second cover 45*b*.

The third cooling duct 48 is formed integrally with the first base plate part 45*ea* of the developing container 45. The first base plate part 45*ea* is made of aluminum, for example, and demarcates the developer storage chambers 41*a* and 41*b* of the developer storage section 41 with the second base plate part 45*eb*, as mentioned earlier. The first base plate part 45*ea* is provided with a flow path that penetrates the first base plate part 45*ea* so as to extend in the longitudinal direction in a position below the developer storage section 41. This flow path constitutes the unit-side third cooling duct 48. Note that, in FIG. 5, four flow paths constitute the third cooling duct 48 but that the number of flow paths is optional.

Figure 9:
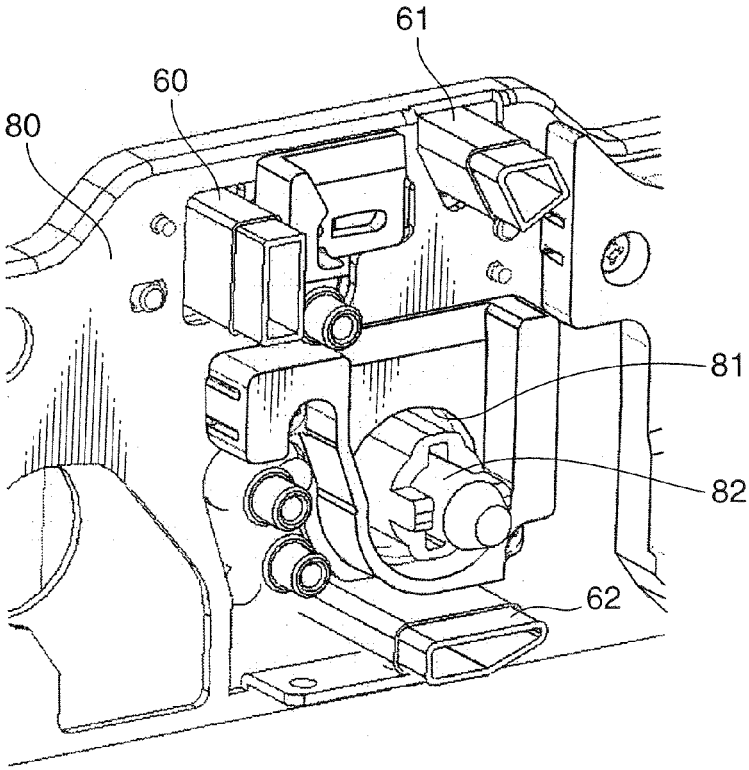
FIG. 9 is a perspective view of first to third cooling ducts which are on a main body side and made to communicate with first to third cooling ducts on a unit-side.

FIG. 9 is a perspective view of the main body-side first to third cooling ducts 60, 61, and 62 that are connected to the first to third duct connecting members 70, 71, and 72. The main body-side first to third cooling ducts 60, 61 and 62 shown in FIG. 9 are set to pass through predetermined through-holes formed in a mounting frame 80, on the side of the apparatus main body 100, for mounting the developing unit 4, and are connected to the corresponding first to third duct connecting members 70, 71, and 72 (FIG. 3) which are formed in the rear side plate 45*d* of the developing container 45. That is, the main body-side first cooling duct 60 is connected to the first duct connecting member 70, the main body-side second cooling duct 61 is connected to the second duct connecting member 71, and the main body-side third cooling duct 62 is connected to the third duct connecting member 72. Furthermore, main body-side first to third cooling ducts (not shown in the drawing) are similarly also connected to the first to third duct connecting members 70, 71, and 72 (FIG. 2) formed in the front side plate 45*c* of the developing container 45. The main body-side first to third cooling ducts 60, 61, and 62 are connected, on an upstream side, to a common duct (not shown) and preferably receive a cooling gas supply from a common cooling gas supply apparatus (a fan when the cooling gas is air). Assuming that the cooling gas flows from the front of the developing unit 4 to the rear, for example, the main body-side first to third cooling ducts 60, 61, and 62 shown in FIG. 9 are downstream-side ducts through which the cooling gas, having passed through the unit-side first to third cooling ducts 46, 47, and 48 in the developing unit 4, is discharged. Note that the main body-side first to third current cooling ducts 60, 61, and 62 on the upstream side have the same shape as the main body-side first to third cooling ducts 60, 61, and 62 on the downstream side.

The mounting frame 80 has a through-hole 81 in a position and below the main side-body first cooling duct 60 and the main side-body second cooling duct 61, and above the main side-body third cooling duct 62. A rotary force transmission member 82, connected to the drive source (not shown in the drawing), for applying a rotary driving force to the screw feeder 44 of the developer storage chamber 41*b* of the developing unit 4, is inserted in this through-hole 81. The rotary force transmission member 82 is connected to the connecting member 84 (FIG. 3) attached to the rear end of the screw feeder 44, and transmits the rotary force to the screw feeder 44. In addition to the rotary force transmission member 82, the mounting frame 80 is provided with various members and electrical wiring in order to mount the developing unit 4 on the mounting frame 80, and therefore in a state where the developing unit 4 is mounted on the mounting frame 80, there is a very narrow space between the rear side plate 45*d* of the developing unit 4 and the mounting frame 80. The space between the front side plate 45*c* of the developing unit 4 and the mounting frame 80 is very narrow for the same reason.

The connection structure of the unit-side first to third cooling ducts 46, 47, and 48 and the main body-side first to third cooling ducts 60, 61, and 62 of the cooling structure will be described next. FIG. 10 is a cross-sectional view, from above the developing unit 4, of the connection structure between the unit-side first cooling duct 46 and the main body-side first cooling duct 60, the cooling structure serving as a representative example. Note that, in the following description, cooling gas flows rearward (that is, downstream) from the front of the developing unit 4 (that is, upstream) as indicated by the arrow. The first duct connecting member 70 includes an upstream-side connecting member 73 and a downstream-side connecting member 74. The upstream-side connecting member 73 (lower connecting member in FIG. 10) is a member that connects a gas outflow portion 63 of the main body-side first cooling duct 60 and an upstream end 46*c* of the unit-side first cooling duct 46, which has a different flow-path cross-sectional area from the flow-path cross-sectional area of the gas outflow portion 63, and includes a gas flow path 75 for establishing communication between the flow path of the gas outflow portion 63 and the flow path of the upstream end 46*c*.

More specifically, the upstream side connecting member 73 includes a main body-side fitting portion 73*a*, which has a gas inflow port (first gas flow path) 73*aa* of substantially the same flow path cross-sectional area as the flow path cross-sectional area of the gas outflow portion 63 of the main body-side first cooling duct 60, and to which the gas outflow portion 63 can be fitted; and a unit-side fitting portion 73*b*, which has a gas outflow port (second gas flow path) 73*bb* of substantially the same flow path cross-sectional area as the flow path cross-sectional area of the unit-side first cooling duct 46, and can be fitted to the upstream end 46*c* of the unit-side first cooling duct 46. The gas flow path 75 of the upstream-side connecting member 73 is configured such that the flow path cross-sectional area gradually increases from the gas inflow port 73*aa* toward the gas outflow port 73*bb*. In other words, the gas flow path 75 of the upstream-side connecting member 73 is formed as a tapered flow path. In this embodiment, the gas inflow port 73*aa* and the gas outflow port 73*bb* are substantially rectangular in shape, and the respective sides of the gas inflow port 73*aa* and the sides of the gas outflow port 73*bb*, which correspond to these sides, are connected, thereby forming four tapered surfaces. Note that the gas inflow port 73*aa* and the gas outflow port 73*bb* need not be rectangular, and may be substantially square, for example. In this case, the four tapered surfaces are at identical oblique angles to one another.

A seal member 85 made of urethane or the like is interposed between the gas outflow portion 63 of the main body-side first cooling duct 60, and the main body-side fitting portion 73*a*, of the upstream-side connecting member 73, to which the gas outflow portion 63 is fitted. Furthermore, the upstream end 46*c* of the unit-side first cooling duct 46 is dimensioned to accommodate the unit-side fitting portion 73*b* of the upstream-side connecting member 73 via the seal member 86 made of urethane or the like. FIG. 11 shows a state in which the seal member 86 is stuck to the unit-side fitting portion 73*b* of the upstream-side connecting member 73.

Meanwhile, the downstream-side connecting member 74 (the upper connecting member in FIG. 10) is a member that connects a gas inflow portion 64 of the main body-side first cooling duct 60', and a downstream end 46*d* of the unit-side first cooling duct 46, which has a different flow path cross-sectional area from the flow path cross-sectional area of the gas inflow portion 64, and includes a gas flow path 76 for establishing communication between the flow path of the gas inflow portion 64 to the flow path of the downstream end 46*d*.

The downstream-side connecting member 74 is a member that is a mirror image of the upstream-side connecting member 73. More specifically, the downstream-side connecting member 74 includes a main body-side fitting portion 74*a*, to which the gas inflow portion 64 of the main body-side first cooling duct 60' can be fitted and which has a gas outflow port 74*aa* of substantially the same flow path cross-sectional area as the flow path cross-sectional area of the gas inflow portion 64; and a unit-side fitting portion 74*b* that can be fitted to the downstream end 46*d* of the unit-side first cooling duct 46 and which has a gas inflow port 74*bb* of substantially the same flow path cross-sectional area as the flow path cross-sectional area of the unit-side first cooling duct 46. The gas flow path 76 of the downstream-side connecting member 74 is configured so that the flow path cross-sectional area gradually decreases from the gas inflow port 74*bb* of the unit-side fitting portion 74*b* toward the gas outflow port 74*aa* of the main body-side fitting portion 74*a*. In other words, the gas flow path 76 of the downstream-side connecting member 74 is formed as a tapered flow path.

Like the upstream-side connecting member 73, the downstream-side connecting member 74 connects the main body-side first cooling duct 60' to the unit-side first cooling duct 46 via the seal members 87 and 88. More specifically, the seal member 87, made of urethane or the like, is interposed between the gas inflow portion 64 of the main body-side first cooling duct 60' and the main body-side fitting portion 74*a* of the downstream-side connecting member 74 to which the gas inflow portion 64 is fitted. Furthermore, the downstream end 46*d* of the unit-side first cooling duct 46 is dimensioned to accommodate the unit-side fitting portion 74*b* of the downstream-side connecting member 74 via the seal member 88 made of urethane or the like.

The seal member 86 wound around the unit-side fitting portion 73*b* of the upstream-side connecting member 73 will be described next, once again with reference to FIG. 11. The unit-side fitting portion 73*b* of the upstream-side connecting member 73 is configured with a substantially rectangular cross-sectional shape that has four sides, including a pair of vertically opposing short sides 80 and 81, and a pair of long sides 82 and 83 that face each other in a lateral direction, for example, and the seal member 86 is wound around these four sides. In this embodiment, the seal member 86 is belt-like with two ends 86*a* and 86*b*, and is wound around the unit-side fitting portion 73*b* as follows, for example. That is, after a first end 86*a* of the seal member 86 is affixed close to the corner formed by the right long side 82 and the lower short side 81, the middle portion of the seal member 86 is affixed to the right long side 82, the upper short side 80, the left long side 83, and finally the lower short side 81 in that order, and the other end 86*b* is disposed in a position matching the first end 86*a*. Hence, a seam 85 of the seal member 86, that is, the position where the first end 86*a* and the other end 86*b* meet, is set close to the corner formed by the right long side 82 and the lower short side 81.

The upstream end 46*c* of the duct main body 46*a* of the unit-side first cooling duct 46 is fitted, from above, to the unit-side fitting portion 73*b* of the upstream-side connecting member 73, so as to cover the sides except the lower short side 81, namely the upper short side 80, and the left and right long sides 82 and 83, via the seal member 86. Thus, the upper short side 80 and the left and right long sides 82 and 83 are on the fitting side, fitted by the upstream end 46*c*, whereas the lower short side 81 is on the non-fitted side, not fitted by the upstream end 46*c*. When the upstream end 46*c* is fitted to the unit-side fitting portion 73*b*, the part affixed to the left and right long sides 82 and 83 of the seal member 86 is subjected to a downward force from the upstream end 46*c*, whereas the other end 86*b* of the seal member 86 affixed to the lower short side 81 is barely subjected to this force. Hence, because this force barely acts at the seam 85 of the seal member 86, the other end 86*b* of the seal member 86 can be prevented from becoming detached from the lower short side 81 when the upstream end 46*c* is fitted to the unit-side fitting portion 73*b*. Consequently, it is possible to prevent impairment of the sealing between the first duct connecting member 70 and the unit-side first cooling duct 46. Note that the lower short side 81, on the non-fitting side, abuts, via the seal member 86, against a stepped portion 87 (FIGS. 6, 7) formed at both ends, in the longitudinal direction, of the base plate 46*b* of the unit-side first cooling duct 46.

In contrast, in cases where the seam 85 of the seal member 86 is located close to the corner formed by the upper short side 80 and the right long side 82, for example, the part of the seal member 86 which is affixed to the right long side 82 is subjected to the aforementioned force when the upstream end 46*c* is fitted to the unit-side fitting portion 73*b* from above, and is easily detached from the right long side 82. When the seal member 86 is detached, the sealing between the first duct connecting member 70 and the unit-side first cooling duct 46 is impaired.

Note that the corner formed by the upper short side 80 and the right long side 82, the corner formed by the upper short side 80 and the left long side 83, and the corner formed by the left long side 83 and the lower short side 81 are both chamfered so as to make it easy to attach the seal member 86, and the corner formed by the lower short side 81 and the right long side 82, where the seam 85 of the seal member 86 is positioned, is shaped at substantially 90°.

Furthermore, the second duct connecting member 71, which connects the unit-side second cooling duct 47 and the main-side second cooling duct 61, is structured in substantially the same way as the first duct connecting member 70, except for its shape. A detailed description of the second duct connecting member 71 is therefore omitted here. Note that, in FIG. 11, a seal member 78 is also wound around the second duct connecting member 71.

According to the cooling structure of the above-described developing unit 4, the unit-side first cooling duct 46 uses part (the base plate 46*b*) of the second cover 45*b* of the developing container 45 that demarcates the internal space of the developing unit 4, and is structured by attaching the duct main body 46*a* to this part. Furthermore, the unit-side second cooling duct 47 uses the developer restricting blade 55 that is fixed to the inner frame 58 of the developing container 45, and is structured by attaching the part 45*aa*, formed into a U-shape, of the first cover 45*a* of the developing container 45 to the developer restricting blade 55. Additionally, the unit-side first cooling duct 46 (unit-side second cooling duct 47) and the main-body first cooling duct 60 (main body-side second cooling duct 61) can be connected simply by fitting, from above, the upstream end 31 (65) and the downstream end 32 (66) of the duct main body 46*a* (45*aa*) of the unit-side first cooling duct 46 (unit-side second cooling duct 47) to the unit-side fitting portion 73*b* of the first duct connecting member 70 (second duct connecting member 71) from above. As a result, the disposition of the unit-side first cooling duct 46 and the unit-side second cooling duct 47 in the internal space of the developing unit 4 is straightforward. In contrast, when all the cooling ducts are a member separate from the developing container, it is difficult to arrange the cooling ducts in the internal space due to the existence of the container cover that demarcates the internal space of the developing container, and the various members provided in the internal space.

Furthermore, according to the cooling structure, even in cases where the unit-side first cooling duct 46 and the main body-side first cooling duct 60, 60' have different flow path cross-sectional areas, the unit-side first cooling duct 46 and the main body-side first cooling duct 60, 60' can be connected without creating a step between the flow path of the gas outflow portion 63 of the main body-side first cooling duct 60 and the flow path of the upstream end 46*c* of the unit-side first cooling duct 46, or between the flow path of the gas inflow portion 64 of the main body-side first cooling duct 60' and the flow path of the downstream end 46*d* of the unit-side first cooling duct 46, due to the respective tapered flow paths 75, 76 of the upstream-side connecting member 73 and the downstream-side connecting member 74 of the first duct connecting member 70. Consequently, eddy generation, which can occur when cooling gas flows close to the step, when one exists, between the unit-side first cooling duct 46 and the main body-side first cooling duct 60, 60', can be suppressed. As a result, the cooling gas flows smoothly between the main body-side first cooling duct 60 and the unit-side first cooling duct 46, and between the unit-side first cooling duct 46 and the main body-side first cooling duct 60', and therefore the cooling structure with favorable cooling efficiency and limited gas volume loss can be provided.

Moreover, because electrical wiring and drive system members of the developing unit 4 exist between the developing unit 4 and the mounting frame 80 on which the developing unit 4 is mounted, that is, around the main body-side first cooling duct 60, 60', it is difficult to increase the flow path cross-sectional area of the main body-side first cooling duct 60, 60'. However, according to the cooling structure of this embodiment, even when it is not possible to increase the flow path cross-sectional area of the main body-side first cooling duct 60, 60', the flow path cross-sectional area of the unit-side first cooling duct 46 can be increased by the respective tapered flow paths 75, 76 of the upstream side connecting member 73 and the downstream side connecting member 74 of the first duct connecting member 70, thereby raising the cooling effect, on the developing unit 4, from the unit-side first cooling duct 46.

Note that the second duct connecting member 71, which connects the main body-side second cooling duct 61 and the unit-side second cooling duct 47, and the third duct connecting member 72, which connects the main body-side third cooling duct 62 and the unit-side third cooling duct 48, are structured in substantially the same way as the above-described first duct connecting member 70, except for their shape. A detailed description of the second duct connecting member 71 and the third duct connecting member 72 is therefore omitted here.

The effect of the cooling structure on the developing unit 4 will be described next. The developing unit 4 generates heat in the course of image formation, as mentioned earlier. More precisely, the developer is subjected to stress between the developer restricting blade 55 and the magnetic roller 51 when scraping is performed by the tip 55*a* of the developer restricting blade 55 in the gap between the developer restricting blade 55 and the magnetic roller 51, and frictional heat is generated. Furthermore, when the developer in the developer storage section 41 is agitated by the screw feeders 43, 44, portions of developer rub against one another, thereby generating frictional heat. When the developer comes to retain heat, due to this frictional heat, this causes a drop in the amount of charging of the developer. Furthermore, because the temperature within the developing unit 4 also increases, the temperature of the toner in the developer also increases, and fuses onto the developer restricting blade 55 and so on, which generates a phenomenon whereby the developer layer is not formed uniformly. As a result, it is difficult to form a good toner image on the peripheral surface of photosensitive drum 2. However, with the image forming apparatus of this embodiment, such frictional heat is dissipated by the unit-side first to third cooling ducts 46, 47, and 48 in the cooling structure, thereby suppressing a temperature increase within the developing unit 4.

More specifically, the frictional heat generated by the agitation of the developer within the developer storage section 41 is transmitted from one end 50*a* of the partition plate 50 to the other end 50*b*, such that the other end 50*b* comes to retain this frictional heat. The other end 50*b* of the partition plate 50 is disposed inside the unit-side first cooling duct 46, and therefore the frictional heat is radiated by the cooling gas that flows within the unit-side first cooling duct 46.

Furthermore, the heat emitted by the developer carried by the peripheral surface of the magnetic roller 51 is transmitted to the main body part 55*b* from the tip 55*a* of the developer restricting blade 55, such that the main body part 55*b* comes to retain this heat. The main body part 55*b* of the developer restricting blade 55 is used as a member for demarcating the flow path of the unit-side second cooling duct 47, and therefore the heat of the main body part 55*b* is dissipated by the cooling gas flowing within the unit-side second cooling duct 47.

In addition, the frictional heat generated by the agitation of the developer within the developer storage section 41 is transmitted to the bottom plate 45*e* that demarcates the space of the developer storage section 41, such that the bottom plate 45*e* comes to retain this frictional heat. The bottom plate 45*e* is provided with the unit-side third cooling duct 48, and therefore the frictional heat is dissipated by the cooling gas that flows within the unit-side third cooling duct.

The unit-side first to third cooling ducts 46, 47, and 48 thus not only suppress an increase in temperature within the developing unit 4, but also suppress the melting of toner contained in the developer. As a result, a high-quality toner image is formed on the peripheral surface of the photosensitive drum 2.

For the image forming apparatus according to the embodiment of the present invention described above, a case where three of each of the unit-side cooling ducts 46, 47, and 48, and the main-side cooling ducts 60, 61, and 62 are employed has been described, but the number of ducts is not limited to three; there may also be two or four of each of such ducts, as long as the desired cooling effect is obtained.

Furthermore, although a case where the cooling structure was applied to the developing unit 4 has been described, the cooling structure may also be applied to the cleaning unit 6, for example.

The developing unit and the image forming apparatus employing the developing unit according to this embodiment described hereinabove are preferably structured as follows:

The developing unit preferably includes a unit main body having an internal space defined by a predetermined frame and capable of supplying a developer to the outside while agitating the developer within the internal space, a unit-side cooling duct attached to the unit main body, and a duct connecting member connecting the unit-side cooling duct and an external duct which supplies a cooling gas to the unit-side cooling duct from outside the unit main body. The unit-side cooling duct is structured by a duct piece and a part of the predetermined frame. The duct piece is detachably attached to the unit main body in opposed relation to the part of the predetermined frame, and has an end that is fitted to the duct connecting member.

According to the developing unit of the above structure, the frictional heat generated by the developer agitation is dissipated by the unit-side cooling duct, and therefore an increase in the temperature of the internal space of the unit main body can be suppressed. Further, the unit-side cooling duct uses a part of the predetermined frame that demarcates the internal space of the unit main body, and is composed by detachably attaching a duct piece to the unit main body in a state where the duct piece faces a part of the frame. As a result, the unit-side cooling ducts can be attached to the unit main body easily in comparison with the structure where all the unit-side cooling ducts are separate from the frame of the unit main body.

With the developing unit of the above structure, preferably, the duct piece is formed to have a substantially U-shaped cross-section with an opening that extends along a flow path of the unit-side cooling duct, and the unit-side cooling duct is structured by closing the opening of the duct piece with the part of the predetermined frame.

With the developing unit of the above structure, preferably, the unit main body includes a developer restricting member fixed to a part of the predetermined frame and restricting an amount of the developer supplied to the outside from the unit main body. The duct piece is formed to have a substantially U-shaped cross-section with an opening that extends along a flow path of the unit-side cooling duct. The developer restricting member is disposed on the part of the predetermined frame to which the duct piece is attached.

With the developing unit of the above structure, preferably, the duct connecting member has a fitting portion to which the end of the duct piece is fitted from a predetermined direction, and a seal member is disposed on the fitting portion. With this structure, sealing can be obtained between the unit-side cooling duct and the duct connecting member using a seal member.

Preferably, the seal member is a belt-like seal member and is wound around the fitting portion, and the seam of the seal member is positioned at a side, of the fitting portion, opposite to the side where the end of the duct piece is fitted from the predetermined direction. With this structure, the seal member is wound such that the seam is located on the side, of the fitting portion, opposite the predetermined direction in which the end of the duct piece is fitted. Hence, when the duct piece is fitted to the fitting portion of the duct connecting member, the seal member is not readily detached from the fitting portion. As a result, impairment of the seal between the unit-side cooling duct and the duct connecting member can be prevented.

With the image forming apparatus employing the developing unit of the above structure, the unit-side cooling duct has a flow path cross-sectional area that differs from a flow path cross-sectional area of the external duct, and the duct connecting member has a tapered flow path to establish communication between a flow path of the unit-side cooling duct and a flow path of the external duct.

With the above structure, even when the respective flow path cross-sectional areas of the unit-side cooling duct and the external duct are different, the two ducts can be connected without generating a step between the flow paths thereof, due to the tapered flow path portions of the duct connecting member. Consequently, eddy generation, which can occur when gas flows close to a step, when one exists, between the two ducts, can be suppressed. As a result, a cooling structure with a high cooling effect and limited gas volume loss can be provided.

The flow path cross-sectional area of the unit-side cooling duct is preferably set larger than the flow path cross-sectional area of the external duct.

Since electrical wiring and drive system members of the processing unit exist around the external duct, it is difficult to increase the flow path cross-sectional area of the external duct. However, according to the cooling structure of this embodiment, even when it is not possible to increase the flow path cross-sectional area of the external duct, the flow path cross-sectional area of the unit-side cooling duct can be increased by the tapered flow paths of the duct connecting member, and therefore the cooling effect, which the unit-side cooling duct has on the processing unit, is further improved.

The duct connecting member preferably includes a main body-side fitting portion and a unit-side fitting portion, the main body-side fitting portion having a first gas flow path of substantially the same flow path cross-sectional area as the flow path cross-sectional area of the external duct and to which the external duct is fitted, the unit-side fitting portion having a second gas flow path of substantially the same flow path cross-sectional area as the flow path cross-sectional area of the unit-side cooling duct and fitted to the unit-side cooling duct, and a flow path between the first and second gas flow paths is configured as the tapered flow path.

The developing unit preferably includes a developer storage section storing the developer and capable of conveying the developer while agitating the developer, a developer carrying member carrying the developer upon receiving the developer from the developer storage section, and a developer restricting member for restricting the amount of the developer which the developer carrying member receives from the developer storage section.

The developing unit preferably further includes a heat dissipating member having a first part extending in the developer storage section and a second part, different from the first part, extending in the unit-side cooling duct. Although the developer generates frictional heat due to its agitation within the developer storage section, with this structure, the second part of the heat-dissipating member extends into a unit-side cooling duct with a high cooling effect, and hence developer heat dissipation can be facilitated.

The developer restricting member preferably has a first part contacting the developer on the developer carrying member, and a second part, different from the first part, extending in the unit-side cooling duct. As a result of this structure, the second part of the developer restricting member extends into a unit-side cooling duct with a high cooling effect, and hence heat generated by the developer on the image developer carrying member can be dissipated.

The developer storage section is preferably defined by a space partitioned by a wall portion, and the unit-side cooling duct is provided so as to extend through a part of the wall portion. With this structure, the high-cooling effect unit-side cooling duct is provided in a wall portion constituting the developer storage section, whereby dissipation of the heat of the developer, which is made to generate frictional heat when agitated in the developer storage section, can be facilitated.

This application is based on Japanese Patent application serial Nos. 2008-252572 and 2008-252573 filed in Japan Patent Office on Sep. 30, 2008, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing unit comprising:

a unit main body having an internal space defined by a predetermined frame and capable of supplying a developer to the outside while agitating the developer within the internal space;

a unit-side cooling duct attached to the unit main body; and a duct connecting member connecting the unit-side cooling duct and an external duct which supplies a cooling gas to the unit-side cooling duct from outside the unit main body, wherein the unit-side cooling duct is structured by a duct piece and a part of the predetermined frame, and the duct piece is detachably attached to the unit main body in opposed relation to the part of the predetermined frame, and has an end that is fitted to the duct connecting member.

2. The developing unit according to claim 1, wherein the duct piece is formed to have a substantially U-shaped cross-section with an opening that extends along a flow path of the unit-side cooling duct, and the unit-side cooling duct is structured by closing the opening of the duct piece with the part of the predetermined frame.

3. The developing unit according to claim 1, wherein the unit main body includes a developer restricting member fixed to a part of the predetermined frame and restricting an amount of the developer supplied to the outside from the unit main body, the duct piece is formed to have a substantially U-shaped cross-section with an opening that extends along a flow path of the unit-side cooling duct, and the developer restricting member is disposed on the part of the predetermined frame to which the duct piece is attached.

4. The developing unit according to claim 1, wherein the duct connecting member has a fitting portion to which the end of the duct piece is fitted from a predetermined direction, and a seal member is disposed on the fitting portion.

5. The developing unit according to claim 4, wherein the seal member is a belt-like seal member and is wound around the fitting portion, and the seam of the seal member is positioned at a side, of the fitting portion, opposite to the side where the end of the duct piece is fitted from the predetermined direction.

6. An image forming apparatus comprising:

an apparatus main body;

an image carrying member disposed in the apparatus main body and on which a toner image is formed; and a developing unit disposed in the apparatus main body and supplying a toner onto the image carrying member to form the toner image on the image carrying member, the developing unit including:

a unit main body having an internal space defined by a predetermined frame and capable of supplying a developer to the outside while agitating the developer within the internal space;

a unit-side cooling duct attached to the unit main body; and a duct connecting member connecting the unit-side cooling duct and an external duct which supplies a cooling gas to the unit-side cooling duct from outside the unit main body, wherein the unit-side cooling duct is structured by a duct piece and a part of the predetermined frame, and the duct piece is detachably attached to the unit main body in opposed relation to the part of the predetermined frame, and has an end that is fitted to the duct connecting member.

7. The image forming apparatus according to claim 6, wherein the unit-side cooling duct has a flow path cross-sectional area that differs from a flow path cross-sectional area of the external duct, and the duct connecting member has a tapered flow path to establish communication between a flow path of the unit-side cooling duct and a flow path of the external duct.

8. The image forming apparatus according to claim 7, wherein the flow path cross-sectional area of the unit-side cooling duct is set larger than the flow path cross-sectional area of the external duct.

9. The image forming apparatus according to claim 8, wherein the duct connecting member includes a main body-side fitting portion and a unit-side fitting portion, the main body-side fitting portion having a first gas flow path of substantially the same flow path cross-sectional area as the flow path cross-sectional area of the external duct and to which the external duct is fitted, the unit-side fitting portion having a second gas flow path of substantially the same flow path cross-sectional area as the flow path cross-sectional area of the unit-side cooling duct and fitted to the unit-side cooling duct, and a flow path between the first and second gas flow paths is configured as the tapered flow path.

10. The image forming apparatus according to claim 7, wherein the developing unit includes a developer storage section storing the developer and capable of conveying the developer while agitating the developer, a developer carrying member carrying the developer upon receiving the developer from the developer storage section, and a developer restricting member for restricting the amount of the developer which the developer carrying member receives from the developer storage section.

11. The image forming apparatus according to claim 10, wherein the developing unit further includes a heat dissipating member having a first part extending in the developer storage section and a second part, different from the first part, extending in the unit-side cooling duct.

12. The image forming apparatus according to claim 10, wherein the developer restricting member has a first part contacting the developer on the developer carrying member, and a second part, different from the first part, extending in the unit-side cooling duct.

13. The image forming apparatus according to claim 10, wherein the developer storage section is defined by a space partitioned by a wall portion, the unit-side cooling duct is provided so as to extend through a part of the wall portion.

14. An image forming apparatus comprising:

an apparatus main body;

a processing unit disposed in the apparatus main body and performing a predetermined processing to form an image on a recording medium; and a cooling structure for cooling the processing unit with a gas, wherein the cooling structure includes:

a unit-side cooling duct disposed within the processing unit;

a main body-side cooling duct attached to the apparatus main body to guide the gas into the unit-side cooling duct, and having a flow path cross-sectional area different from that of the unit-side cooling duct; and a duct connecting member connecting the unit-side cooling duct and the main body-side cooling duct to allow the ducts to communicate with each other, wherein the duct connecting member has a tapered flow path establishing communication between a flow path of the unit-side cooling duct and a flow path of the main body-side cooling duct.

15. The image forming apparatus according to claim 14, wherein the flow path cross-sectional area of the unit-side cooling duct is set larger than the flow path cross-sectional area of the main body-side cooling duct.

16. The image forming apparatus according to claim 15, wherein the duct connecting member includes a main body-side fitting portion and a unit-side fitting portion, the main body-side fitting portion having a first gas flow path of substantially the same flow path cross-sectional area as the flow path cross-sectional area of the external duct and to which the external duct is fitted, the unit-side fitting portion having a second gas flow path of substantially the same flow path cross-sectional area as the flow path cross-sectional area of the unit-side cooling duct and fitted to the unit-side cooling duct, and a flow path between the first and second gas flow paths is configured as the tapered flow path.

17. The image forming apparatus according to claim 14, wherein the processing unit is a developing unit that includes a developer storage section storing the developer and capable of conveying the developer while agitating the developer, a developer carrying member carrying the developer upon receiving the developer from the developer storage section, and a developer restricting member for restricting the amount of the developer which the developer carrying member receives from the developer storage section.

18. The image forming apparatus according to claim 17, wherein the developing unit further includes a heat dissipating member having a first part extending in the developer storage section and a second part, different from the first part, extending in the unit-side cooling duct.

19. The image forming apparatus according to claim 17, wherein the developer restricting member of the developing unit has a first part contacting the developer on the developer carrying member, and a second part, different from the first part, extending in the unit-side cooling duct.

20. The image forming apparatus according to claim 17, wherein the developer storage section is defined by a space partitioned by a wall portion, the unit-side cooling duct is provided so as to extend through a part of the wall portion.

* * * * *